United States Patent [19]

Fortin et al.

[11] 4,437,543

[45] Mar. 20, 1984

[54] CONTROL SYSTEM FOR CAGE SUPPORTED BY ARTICULATED BOOM

[75] Inventors: Paul Fortin, Loretteville; Paul Michaud, Ancienne-Lorette; Martin Pernicka, Loretteville, all of Canada

[73] Assignee: Poudrier Frere Ltee, Quebec, Canada

[21] Appl. No.: 291,516

[22] Filed: Aug. 10, 1981

[51] Int. Cl.[3] ..... B66F 11/04

[52] U.S. Cl. ..... 182/2; 182/13

[58] Field of Search ..... 182/2, 13; 414/699, 414/724; 175/219

[56] References Cited

U.S. PATENT DOCUMENTS

| | | | |
|---|---|---|---|
| 2,905,262 | 9/1959 | Zwight | 182/2 |
| 2,940,539 | 6/1960 | Richey | 182/2 |
| 3,066,756 | 12/1962 | Broderson | 182/2 |
| 3,301,346 | 1/1967 | Verrell | 182/2 |
| 3,360,076 | 12/1967 | Stilwell | 182/2 |
| 3,483,948 | 12/1969 | Thornton | 182/2 |
| 3,994,365 | 11/1976 | Petermann | 182/2 |
| 4,044,856 | 8/1977 | Stevenson | 182/2 |
| 4,113,054 | 9/1978 | Myers | 182/2 |
| 4,290,584 | 9/1981 | Eckels | 182/2 |

*Primary Examiner*—R. P. Machado
*Assistant Examiner*—Alvin Chin-Shue
*Attorney, Agent, or Firm*—Oblon, Fisher, Spivak, McClelland & Maier

[57] ABSTRACT

A control system for a personnel carrier attached to a boom which is displaceable by pressure fluid. The control system comprises at least one hand operable controlled handle axially rotatable in a limited clockwise or counter-clockwise direction to cause the boom to be elevated or lowered, respectively. A control valve is associated with the control handle and has at least one adjustable pressure fluid control component therein to control the displacement of the boom. A movable linkage is secured at one end to the control handle and at an opposed end to the fluid control component whereby rotation of the control handle causes displacement of the control component to regulate the pressure fluid which in turn controls the displacement of the boom.

9 Claims, 4 Drawing Figures

CONTROL SYSTEM FOR CAGE SUPPORTED BY ARTICULATED BOOM

BACKGROUND OF INVENTION (a) Field of the Invention

The present invention relates to an improved control system for displacing a personnel carrier attached to a boom and more specifically to a control system which is secured to the personnel carrier and operable by an axially rotatable control handle whereby the carrier may be smoothly displaced in an efficient manner.

(b) Description of Prior Art

Various control systems are known for displacing a personnel carrier which is secured to the end of a boom. The control systems provided in the personnel carrier are lever type systems whereby the displacement of the lever in a particular direction causes the support boom to be displaced and, in turn, the personnel carrier. However, these type of levers do not offer a sensitive type control and by displacing them a small increment, the boom will respond with a quick jerky movement, thereby causing the carrier to be displaced in a likewise manner and often resulting in the operator momentarily losing his balance. Momentary loss of balance causes the operator to further pull on the lever or levers, causing further abrupt movements of the boom and the carrier, and often resulting in injury to the operator.

Another disadvantage of the prior art is that a plurality of these levers are provided, one for moving a boom section in one direction, another for moving the same boom section in an opposite direction and a third for the rotation of the boom. Also, these levers are mounted in a side-by-side relationship in the same plane. Accordingly, the operation of the boom becomes confusing and there is a greater margin for error in the operation of same, which could also result in injury to the operator. As aforementioned, lever controls do not offer delicate precise displacement of the boom and often results in the personnel carrier striking an object which is close by, causing damage to the carrier or the object that it strikes.

SUMMARY OF INVENTION

It is a feature of the present invention to provide an improved control system which substantially overcomes all of the above-mentioned disadvantages of the prior art.

A further feature of the present invention is to provide a control system which is secured to a personnel carrier and which provides safe, smooth and sensitive operation of the displacement of the boom supporting the personnel carrier.

A further feature of the present invention is to provide a control system secured to a personnel carrier and comprising axially rotatable control handles, each causing a boom section to be displaced in either one of two directions and at the same time offering added security to the operator.

According to the above features, from a broad aspect, the present invention provides a control system secured to a personnel carrier attached to a boom which is displaceable by pressure fluid. The control system comprises at least one hand operable controlled handle axially rotatable in a limited clockwise or counter-clockwise direction to cause the boom to be elevated or lowered, respectively. A control valve is associated with the control handle and has at least one adjustable pressure fluid control component therein to control the displacement of the boom. A movable linkage is secured at one end to the control handle and at an opposed end to the fluid control component whereby rotation of the control handle causes displacement of the control component to regulate the pressure fluid which in turn controls the displacement of the boom.

BRIEF DESCRIPTION OF DRAWINGS

A preferred embodiment of the present invention will now be described with reference to the example thereof as illustrated in the accompanying drawings, in which.

DESCRIPTION OF PREFERRED EMBODIMENTS

Figure 1:
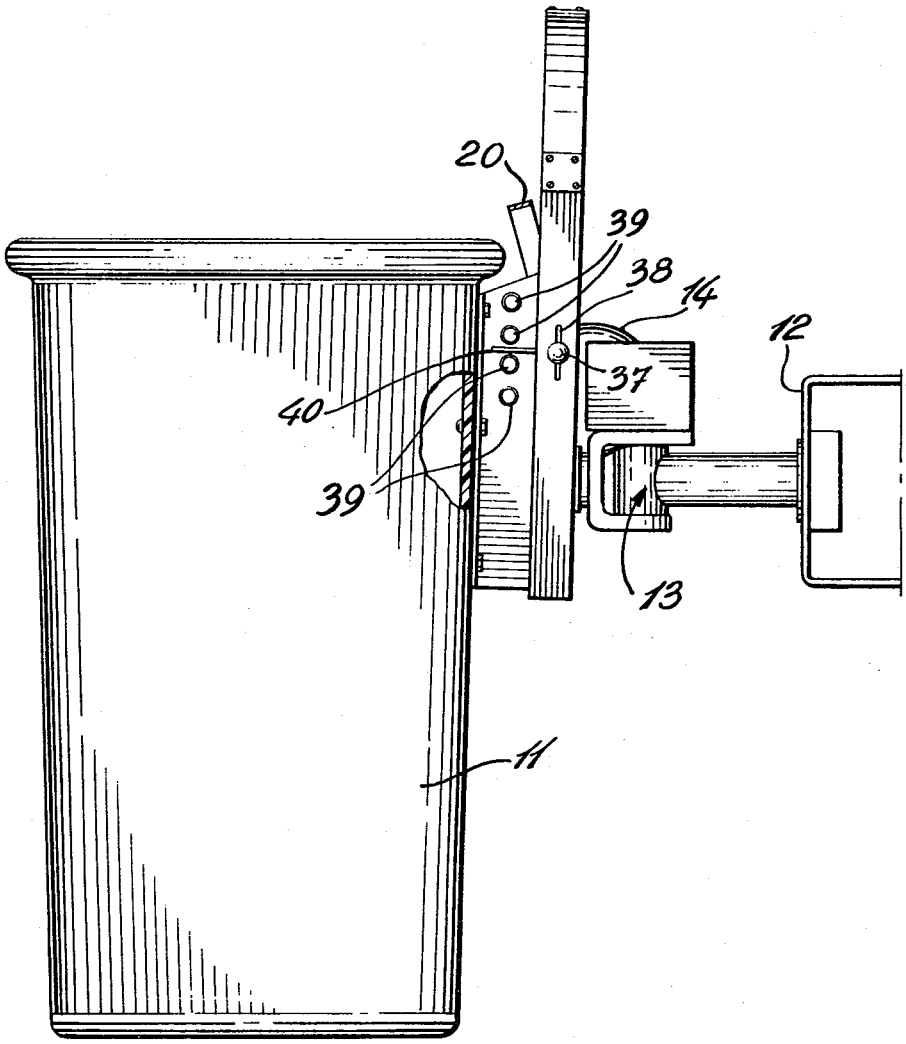
FIG. 1 is a fragmented side view showing the control systems secured to a personnel carrier.
Figure 2:
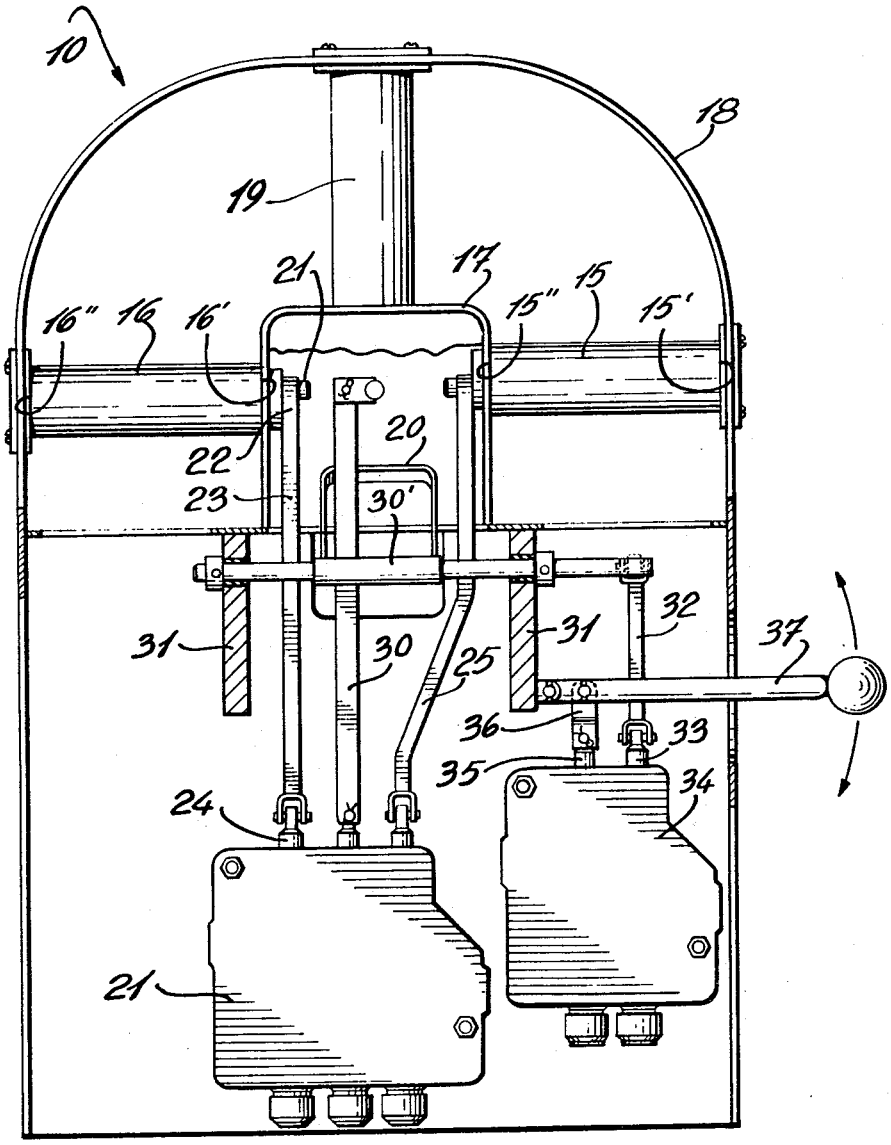
FIG. 2 is a fragmented section view showing the control system as secured in the system housing.

Referring now to the drawings and more particularly to FIGS. 1 and 2, there is shown generally at 10 the control system of the present invention as secured to a personnel carrier or cage 11. The cage 11 is secured to the end of a boom 12 by a suitable articulated connection 13, as is well known in the art, whereby the personnel carrier 11 may be displaced arcuately at the end of a boom by hand operable means such as the crank 14.

The control system 10 of the present invention comprises two horizontally disposed hand operable control handles 15 and 16 for controlling displacement of the boom and which are axially rotatably supported adjacent opposed end faces 15', 15" and 16', 16", respectively, between an inner support frame 17 and an outer support frame 18. The outer support frame 18 also provides a hand-guard for the operator.

A third vertically disposed control handle 19 is vertically mounted for axial rotation in a similar manner as the first and second handles 15 and 16 for rotational displacement between the inner and outer frames 17 and 18 respectively. This third handle 19 controls a turret base (not shown) on to which the lower end of the boom 12 is secured whereby the boom and the personnel carrier 11 may be displaced along an arc of a circle. The boom 12 is a two-section boom having a lower and upper articulated section (not shown) as is well known in the art. The right-hand control handle 15 is mounted upwardly of the second control handle 16 and operates the uppermost one of the boom sections, whereas the other handle 16, which is lowermost of the handle 15, operates the lower section of the boom.

A brake handle 20 is further provided immediately forwardly of the frames 17, 18, as is more clearly shown in FIG.1, to disable the handles 15, 16 and 19 in an emergency type situation or otherwise.

Referring now additionally to FIG. 2, it can be seen that the control handles 15, 16 and 19 are connected to a pressure fluid control valve 21', herein an hydraulic fluid control valve. The connection of the horizontal control handles 15 and 16 is identical and one of these will now be described. The control handle 16 is a cylindrical handle member having a link arm connecting pin 21 in its opposed end face 16' to which one end 22 of a link arm 23 is connected whereby the link arm 23 is displaceable along its longitudinal axis in an upward and downward direction whereby to cause an adjustable pressure fluid control component connection 24 to be displaced from a neutral position. The construction of control valve 21' does not form part of the invention and is well known in the art. The control component connection 24 is usually spring biased to a neutral position. Therefore, by displacing the control lever 23 upwardly or downwardly a force is applied against the spring bias to displace the conrol component in the valve whereby fluid pressure to the lower boom section (when the handle 16 is rotatably displaced) will cause the lower boom section to be raised or lowered on its lower articulated connection (not shown).

Similarly, the clockwise or counter-clockwise rotational displacement of the control handle 15 will cause its associated lever 25 to displace the associated fluid control component in the valve 21' to displace its associated upper section of the boom on a lower articulated connection to the upper part of the lower section of the boom, as is well known in the art.

Figure 4:
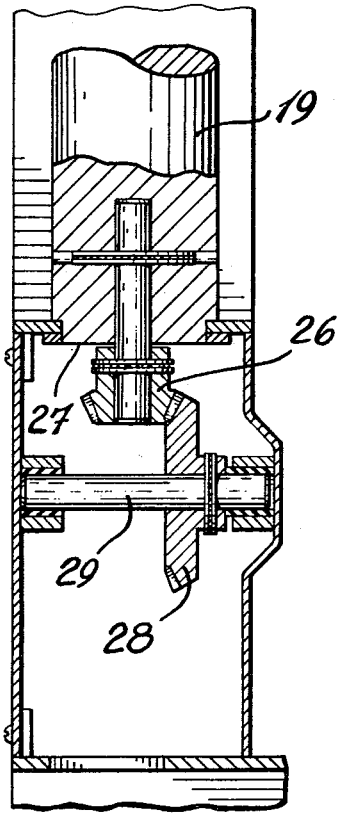
FIG. 4 is a fragmented section view showing the link connection of the vertical control handle.

As shown in FIG. 4, the vertical control handle 19 is provided with a pinion gear 26 centrally secured in a lower end face 27 of the handle and is in toothed engagement with a further gear 28 which is secured to a rotatable link attachment rod 29. A linkage 30 is secured to the rod 29 (see FIG. 2) whereby rotation of the rod 29 will cause the linkage 30 to move upwardly or downwardly whereby to also control a third fluid control component which in turn controls fluid pressure for clockwise or counter-clockwise rotation of the turret base (not shown). A spring biased connection 30'' biases the arm in its normal position when not activated.

Figure 3:
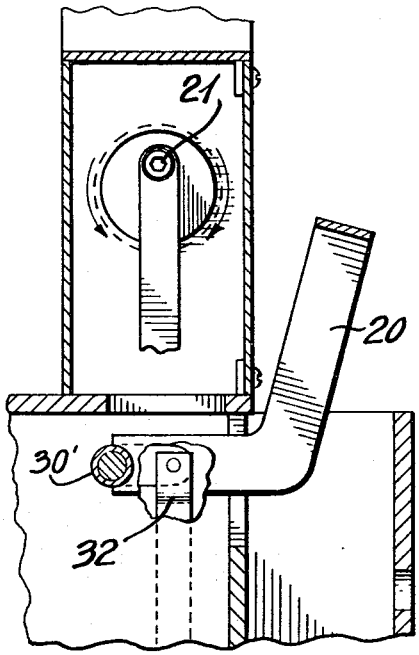
FIG. 3 is a fragmented section view showing the link connection of the control handles and the brake handle.

Referring now to FIGS. 2 and 3, it can be seen that the brake 20 is secured at a lower end to a pivot rod 30' pivotally supported between frame members 31 whereby downward displacement of the brake handle 20 causes the rod 30' to rotate which in turn causes the link arm 32 to move downwardly. The link arm 32 is secured to a connector end 33 of a fluid cut-off component (not shown)of a master valve 34 whereby to cut off fluid pressure to the control valve 21' thereby disabling the control valve 21' and the handles 15, 16 and 19.

As shown in FIG. 2, the master control valve 34 is provided with a further fluid control component connection 35 which is also displaceable by a linkage 36 connected to a selectively displaceable control lever 37. The lever 37 is displaceable along a vertical slot 38 (see FIG. 1) to a selected one of three positions, two of such positions being associated with two pressure connectors 39 to which various working tools may be connected. A third of these positions, position 40, is the neutral position of the associated fluid control component of the master valve 34. When the control lever 37 is in either of the connector positions the fluid pressure to the control valve 21' is also cut off and the valve 21' and the control handles 15, 16 and 19 are disabled.

The hydraulic circuitry with respect to the boom sections have not been disclosed herein as these are obvious to a man skilled in the art and do not form part of the present invention. Also, it is intended to cover any obvious modifications of the example of the preferred embodiment disclosed herein provided such modifications fall within the scope of the appended claims.

We claim:

1. A control system for a personnel carrier attached to a boom which is displaceable by pressure fluid, said control system comprising three hand operable control handles axially rotatable in a limited clockwise or counter-clockwise direction to cause said boom to be elevated or lowered respectively, a control valve associated with each of said control valve associated with each of said control handles and having at least one adjustable pressure fluid control component therein to control the displacement of said boom, a movable linkage secured at one end to each of said control handles and at an opposed end to said fluid control component whereby rotation of said control handles causes displacement of said control component to regulate said pressure fluid which in turn controls the displacement of said boom, said boom being a two-section articulated boom, two of said handles being horizontally mounted for an operator's right and left hand, each of said two handles controlling the displacement of a respective one of said boom sections, and a third of said control handles being vertically mounted and controlling the rotational displacement of a turret base onto which said boom is secured whereby to displace said boom along an arc of a circle.

2. A control system as claimed in claim 1 wherein there is further provided a brake handle, a master valve connected to said control valve and having a pressure fluid cut-off component to disable said control valve, a movable linkage secured at one end to said brake handle and at an opposed end to said cut-off component to actuate said master valve to enable or disable said first, second and third control handles.

3. A control system as claimed in claim 2 wherein there is further provided a selectively displaceable control lever connected through a linkage to said master valve to direct pressure fluid to a selected one of a plurality of pressure connectors to which working tools are connectable, said control lever automatically disabling said control valve to prevent displacement of said boom when said lever is displaced to selected ones of a plurality of positions associated with said connectors.

4. A control system as claimed in claim 1 wherein each of said three control handles comprises a cylindrical handle member pivotally supported at opposed end faces, a link arm connecting pin in one of said end faces to which said one end of said movable linkage is secured to said connecting pin being offset from the central longitudinal axis of said cylindrical handle member, said fluid control component being spring biased to a neutral position whereby said handle normally rests at a neutral position through said movable linkage connection, said handle when rotated on its central longitudinal axis applying a force against said spring biased control component to cause displacement thereof from its neutral position.

5. A control system as claimed in claim 4 wherein said third control handle has a pinion gear centrally secured in a lower end face thereof and in toothed engagement with a further gear secured to a rotatable link attachment rod whereby rotation of said rotatable link attachment rod and displacement of a further movable linkage secured at a lower end to a third fluid control component to control fluid pressure for clockwise or counter-clockwise rotation of said turret base.

6. A control system as claimed in claim 5 wherein said control handles are secured between an inner and outer support frame, said outer support frame constituting a hand guard, said support frames being secured to a control system housing fastened to said carrier whereby said control handles are disposed at a convenient height with respect to a carrier support platform.

7. A control system as claimed in claim 1 wherein said pressure fluid is a hydraulic fluid, and pressure fluid lines for connecting said fluid in said system.

8. A control system as claimed in claim 1 wherein one of said two horizontally mounted control handles is elevated from the other handle, said elevated handle controlling a higher one of said boom sections.

9. A control system for a personnel carrier attached to a boom which is displaceable by pressure fluid, said control system comprising three hand operable control handles axially rotatable in a limited clockwise or counterwise direction to cause said boom to be elevated or lowered respectively, a control valve associated with each of said control handles and having at least one adjustable pressure fluid control component therein to control the displacement of said boom, a movable linkage secured at one end to each of said control handles and at an opposed end to said fluid control component whereby rotation of said control handles causes displacement of said control component to regulate said pressure fluid which in turn controls the displacement of said boom, said boom being a two-section articulated boom, two of said handles being horizontally mounted for an operator's right and left hand, each of said two handles controlling the displacement of a respective one of said boom sections, and one of said two horizontally mounted control handles in elevated from the other handle, said elevated handle controlling a higher one of said boom sections.

* * * * *